US010821769B2

(12) United States Patent
Ifkovits et al.

(10) Patent No.: US 10,821,769 B2
(45) Date of Patent: Nov. 3, 2020

(54) MAIL-PIECE INSERTION SYSTEM HEAVIES ROTARY FEEDER DOUBLE DETECT SYSTEM AND METHOD

(71) Applicants: Thomas E. Ifkovits, New Fairfield, CT (US); Andre P. Tremblay, Danbury, CT (US); John Masotta, Newtown, CT (US); Art H. DePoi, Brookfield, CT (US); Boris Rozenfeld, Danbury, CT (US)

(72) Inventors: Thomas E. Ifkovits, New Fairfield, CT (US); Andre P. Tremblay, Danbury, CT (US); John Masotta, Newtown, CT (US); Art H. DePoi, Brookfield, CT (US); Boris Rozenfeld, Danbury, CT (US)

(73) Assignee: DMT Solutions Global Corporation, Danbury, CT (US)

( * ) Notice: Subject to any disclaimer, the term of this patent is extended or adjusted under 35 U.S.C. 154(b) by 208 days.

(21) Appl. No.: 16/218,811

(22) Filed: Dec. 13, 2018

(65) Prior Publication Data

US 2020/0189311 A1 Jun. 18, 2020

(51) Int. Cl.
*B43M 3/04* (2006.01)
*B65H 9/12* (2006.01)

(52) U.S. Cl.
CPC ..... *B43M 3/04* (2013.01); *B65H 9/12* (2013.01); *B65H 2701/1916* (2013.01); *B65H 2801/66* (2013.01)

(58) Field of Classification Search
CPC combination set(s) only.
See application file for complete search history.

(56) References Cited

U.S. PATENT DOCUMENTS

| | | | | |
|---|---|---|---|---|
| 6,226,626 | B1 * | 5/2001 | Thiel | G07B 17/00362 700/221 |
| 7,181,895 | B1 * | 2/2007 | Rozenfeld | B43M 3/045 53/284.3 |
| 7,775,015 | B1 * | 8/2010 | Crowley | B65H 3/38 53/55 |
| 9,157,729 | B1 * | 10/2015 | Bergeron | B65H 5/14 |
| 2003/0009991 | A1 * | 1/2003 | Iwamoto | B43M 3/045 53/460 |
| 2006/0254223 | A1 * | 11/2006 | Passoni | B43M 3/045 53/492 |

(Continued)

*Primary Examiner* — Kyle O Logan
(74) *Attorney, Agent, or Firm* — Buckley, Maschoff & Talwalkar LLC

(57) ABSTRACT

According to some embodiments, a double detection apparatus for a mail-piece inserter includes a detectable flag affixed to a rotating mail-piece gripper of a mail-piece rotary feeder. A stationary proximity sensor may generate a voltage output based on a presence of the detectable flag in a direction along a first axis normal to the rotation of the mail-piece gripper. A decision unit may then generate a double detect alert signal when a phase shift above a pre-determined threshold value is detected in the voltage output generated by the stationary proximity sensor. According to some embodiments, the decision unit may also generate a thin detect alert signal when a phase shift past another pre-determined threshold value is detected in the voltage output generated by the stationary proximity sensor.

20 Claims, 12 Drawing Sheets

(56) References Cited

U.S. PATENT DOCUMENTS

| | | | | |
|---|---|---|---|---|
| 2007/0179665 | A1* | 8/2007 | Welch | G07B 17/00467 700/220 |
| 2010/0276249 | A1* | 11/2010 | Kalm | B65H 7/04 198/418.9 |
| 2011/0184552 | A1* | 7/2011 | Van Den Berg | B43M 3/04 700/220 |
| 2012/0131885 | A1* | 5/2012 | Matsushita | B43M 3/045 53/473 |
| 2012/0322641 | A1* | 12/2012 | Matsushita | B43M 3/045 493/405 |
| 2013/0020752 | A1* | 1/2013 | Kapturowski | B65H 3/0875 271/10.09 |
| 2015/0068160 | A1* | 3/2015 | Kudrus | B65H 39/06 53/447 |
| 2016/0243884 | A1* | 8/2016 | Arthur | B43M 3/045 |
| 2016/0244286 | A1* | 8/2016 | Padros | B65H 3/56 |
| 2019/0160856 | A1* | 5/2019 | Middelberg | B31B 70/262 |

* cited by examiner

1400

| 1402 INSERTER IDENTIFIER | 1404 ROTARY FEEDER IDENTIFIER | 1406 DATE (TIME) | 1408 MINIMUM VOLTAGE DRUM ANGLE | 1410 AVERAGE OF LAST FIVE DRUM ANGLES | 1412 STATUS |
|---|---|---|---|---|---|
| I_101 | RF_101 | | 41 | 42.2 | SINGLE |
| I_101 | RF_101 | | 42 | 42.4 | SINGLE |
| I_101 | RF_101 | | 42 | 42.5 | SINGLE |
| I_102 | RF_201 | | 45 | 42.5 | DOUBLE DETECT ALERT |

FIG. 14

MAIL-PIECE INSERTION SYSTEM HEAVIES ROTARY FEEDER DOUBLE DETECT SYSTEM AND METHOD

TECHNICAL FIELD

The invention disclosed herein relates generally to paper handling equipment, and more particularly to an inserter system for assembling mail pieces.

BACKGROUND

FIG. 1 is a front elevational view of a conventional inserter system 100. As seen from FIG. 1, the inserter system 100 (such as a four-station EPIC™ insertion solution available from BLUECREST®) may include a number of friction feeders 110 attached to a chassis 120. The inserter system 100 may also include a rotary feeder 130 and a heavies rotary feeder 140. According to some embodiments, the inserter system 100 also includes an envelope feeder (not shown in FIG. 1). Envelopes are fed from the envelope feeder to an insertion station (e.g., an inserter or insertion system), at which each mail-piece is inserted into a respective one of the envelopes. Sealing and metering of the resulting mail pieces may be performed downstream from the inserter system 100, in a mailing machine which is not shown.

Typically, a mail-piece rotary feeder grabs a single mail-piece and inserts it into an envelope fed from the envelope feeder. In some cases, a mail-piece rotary feeder might accidently grab two mail-pieces (e.g., a "double"). Attempting to insert both mail-pieces into a single envelope, however, could jam the inserter system 100 and potentially even cause damage to the apparatus (to avoid this result, the system 100 might automatically halt operation when a double is detected). Moreover, note that the space available within a rotary feeder might be limited. A need, therefore, exists for a "double detection" apparatus that can quickly and accurately detect the presence of a double in a geometrically efficient manner.

SUMMARY

According to some embodiments, a double detection apparatus for a mail-piece inserter includes a detectable flag affixed to a rotating mail-piece gripper of a mail-piece rotary feeder. A stationary proximity sensor may generate a voltage output based on a presence of the detectable flag in a direction along a first axis normal to the rotation of the mail-piece gripper. A decision unit may then generate a double detect alert signal when a phase shift above a pre-determined threshold value is detected in the voltage output generated by the stationary proximity sensor. According to some embodiments, the decision unit may also generate a thin detect alert signal when a phase shift past another pre-determined threshold value is detected in the voltage output generated by the stationary proximity sensor.

Some embodiments comprise: means for receiving, at a double detection apparatus, a voltage output generated by a stationary proximity sensor based on a presence of a detectable flag in a direction along a first axis normal to the rotation of a mail-piece gripper of a mail-piece rotary feeder, wherein the detectable flag is affixed to the rotating mail-piece gripper; and means for generating, by a decision unit of the double detection apparatus, a double detect alert signal when a phase shift above a pre-determined threshold value is detected in the voltage output generated by the stationary proximity sensor.

Some technical advantages of some embodiments disclosed herein are improved systems and methods to provide a "double detection" apparatus that can quickly and accurately detect the presence of a double in a geometrically efficient manner.

BRIEF DESCRIPTION OF THE DRAWINGS

FIG. 14 is a tabular view of a portion of a decision unit database according to some embodiments.

DETAILED DESCRIPTION

In the following detailed description, numerous specific details are set forth in order to provide a thorough understanding of embodiments. However, it will be understood by those of ordinary skill in the art that the embodiments may be practiced without these specific details. In other instances, well-known methods, procedures, components and circuits have not been described in detail so as not to obscure the embodiments.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Figure 1:
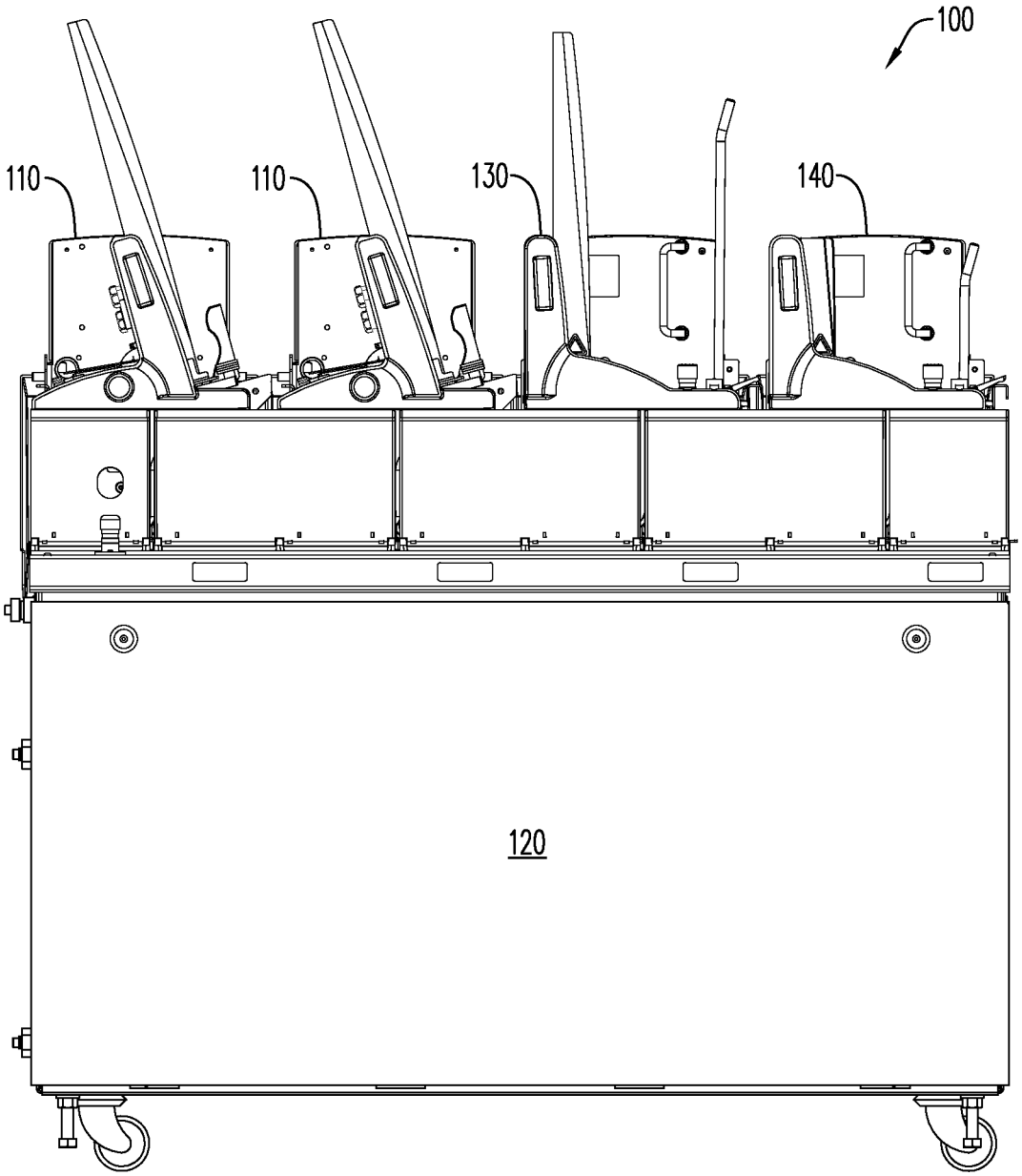
FIG. 1 is a front elevational view of an inserter system in which some embodiments may be applied.
Figure 2:
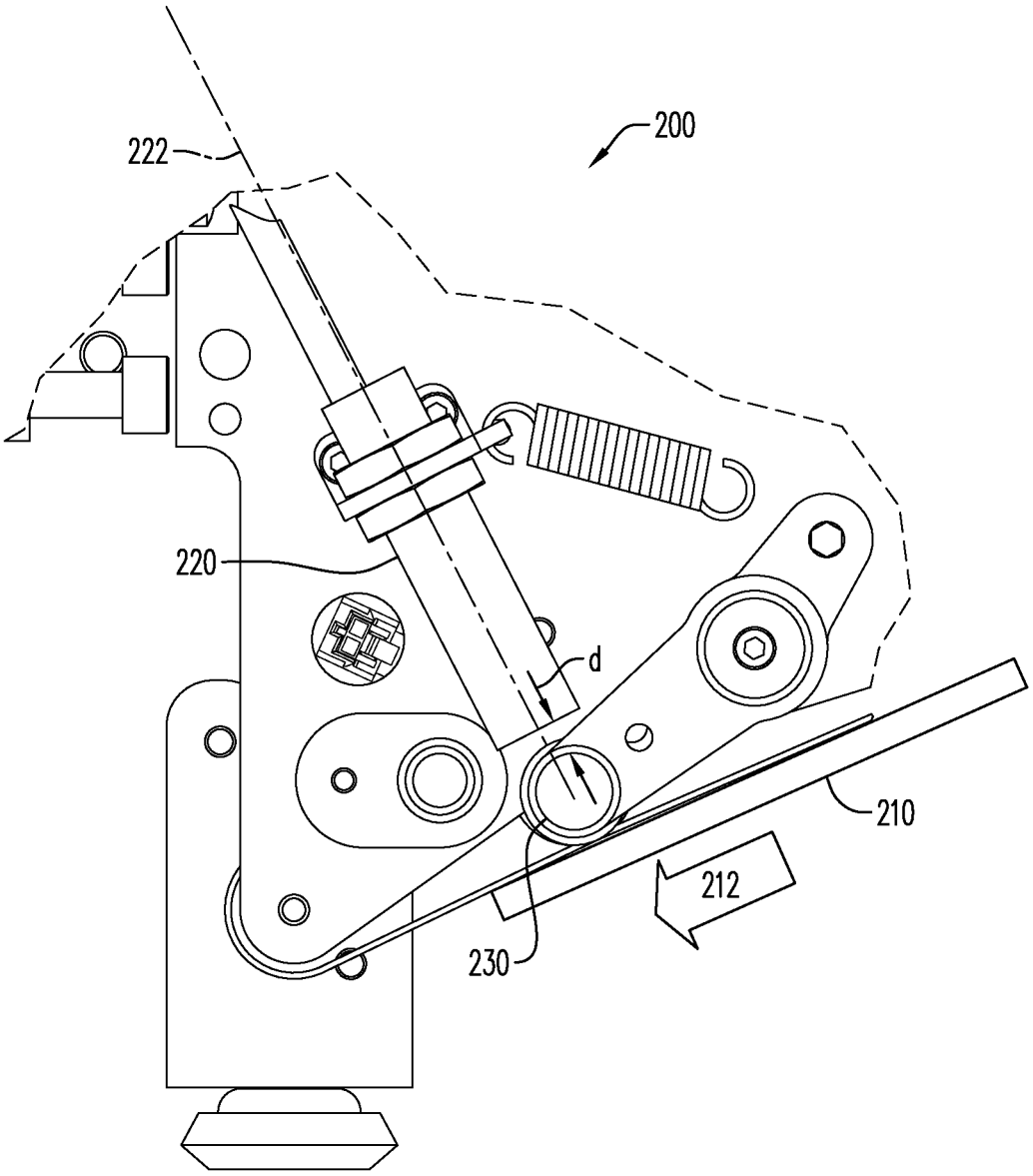
FIG. 2 is a side view of a typical double feed detection design for a rotary feeder.

Attempting to insert multiple mail-pieces into a single envelope can lead to problems for an inserter system (e.g., the process might jam the inserter and potentially even cause damage to the apparatus). To avoid such a result, FIG. 2 is a side view of a typical double feed detection design 200 for a rotary feeder. The rotary feeder might be associated with, for example, an EPIC™ inserting solution available from BLUECREST. In particular, the design 200 is shown moving a single mail-piece 210 (e.g., normal operation) in a feed direction 212. A proximity sensor 220 generates a voltage output based on a presence of a detectable flag 230 in a direction along a first axis 222. The detectable flag 230 might comprise, for example, a ferrous, magnetic, or any other type of material that can be sensed by the proximity sensor 220. When a single mail-piece 210 moves through the design 200, the distance between the proximity sensor 220 and the detectable flag 230 is d (as illustrated in FIG. 2). When two mail-pieces move through the design 200 at the same time, the distance d between the proximity sensor 220 and the detectable flag 230 will be reduced (e.g., because the detectable flag 230 will be pushed up higher in FIG. 2 which will change the voltage output from the proximity sensor 220).

In this typical implementation, a double feed on a rotary feeder might be detected by comparing the voltage output from the proximity sensor 220 to a pre-determined threshold value. This approach to detecting doubles uses the flag 230 on a lever arm with a roller attached with the proximity sensor 220 looking at the flag. The proximity sensor 220 may emit an electromagnetic field that can be altered by the detectable material (e.g., the flag 230), and when the flag 230 is moved either closer or farther away (altered by the material thickness of the mail-piece(s) 210 being processed) the electromagnetic field is altered thus changing the voltage that is output from the sensor 220. If this voltage is within a given range (or outside of a given range or threshold), a double can be declared.

Note that the space available within a rotary feeder might be limited. To save space, the proximity sensor 220 might be rotated 90 degrees such that the axis 222 points "into" the page illustrated in FIG. 2. With this geometry, the usual method of using voltage from the proximity sensor 220 to determine the distance d to the flag 230 may not work (e.g., the voltage output value between a single and a double might have the possibility of an overlap causing false doubles and/or missed doubles).

Figure 3:
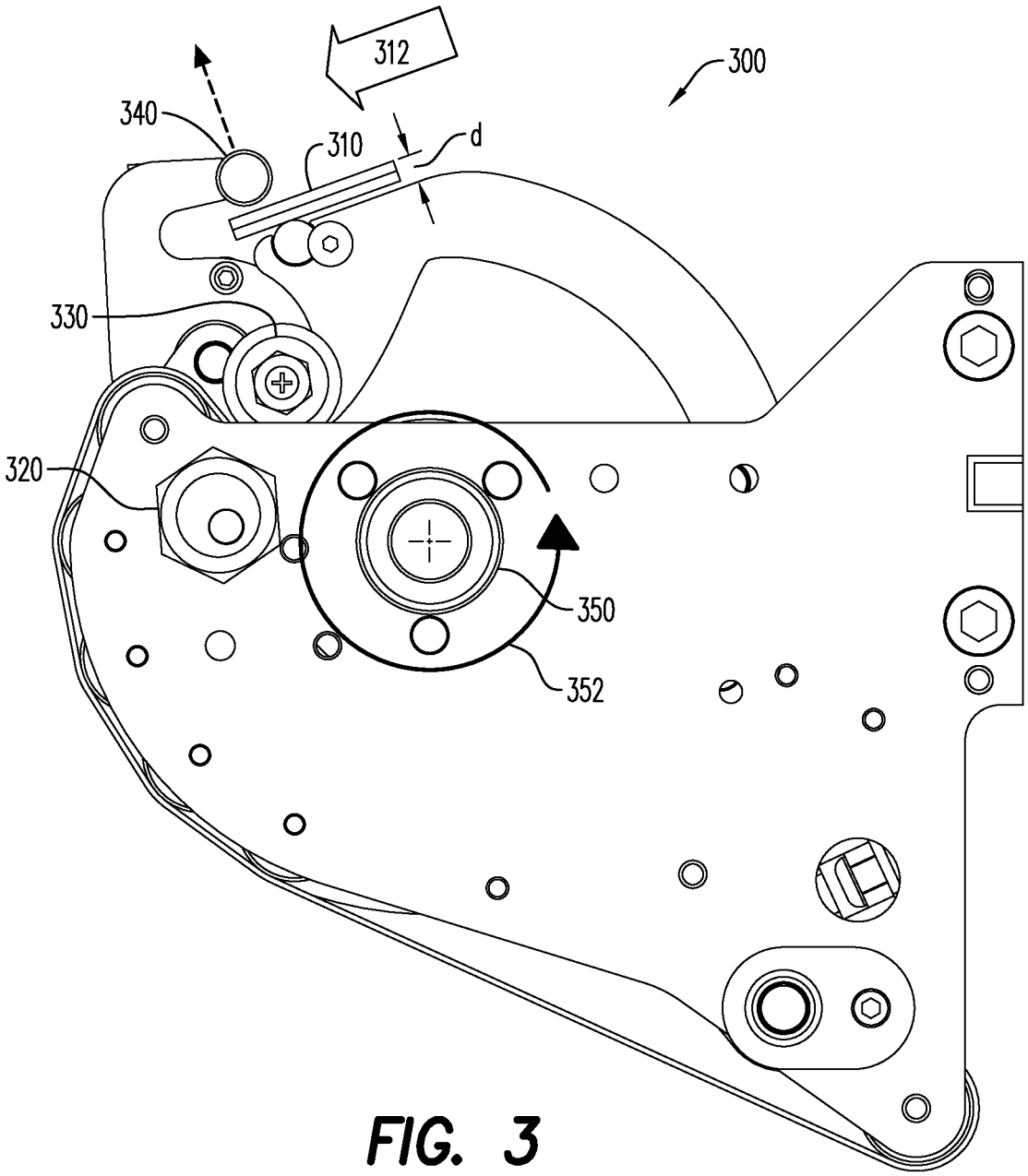
FIG. 3 is a side view of a double feed detection design for a rotary feeder in accordance with some embodiments.

A need, therefore, exists for a "double detection" apparatus that can quickly and accurately detect the presence of a double in a geometrically efficient manner. FIG. 3 is a side view of a double feed detection design 300 for a rotary feeder in accordance with some embodiments. The design 300 illustrated in FIG. 3 shows a double 310 (e.g., two mail-pieces) being processed in a direction of travel 312. A stationary proximity sensor 320 generates a voltage output based on a presence of a detectable flag 330 in a direction along a first axis normal to the rotation of a mail-piece gripper 340 (about an axis of rotation 350 as illustrated by arrow 352). As described in connection with FIGS. 4 through 14, a decision unit may then be provided to generate a double detect alert signal when a phase shift above a pre-determined threshold value is detected in the voltage output generated by the stationary proximity sensor 320.

Note that the mail-piece gripper 340 may be associated with a drum angle that rotates 360 degrees to process each mail-piece 310. Moreover, the stationary proximity sensor 320 may be located such that movement of the detectable flag 330 generates a repeating voltage output waveform as the drum angle changes. That is, the repeating voltage output waveform might result from the detectable flag 330 "eclipsing" a field of view of the stationary proximity sensor 320 along the first axis (into the page). As used herein, the term "eclipse" may refer to any motion of an item into a field of view. As a result of such motion, the voltage output waveform might comprise a parabolic waveform.

Using the flag 330 located on the gripper 340 of the rotary feeder (which rotates a full rotation on every cycle), the resulting eclipse of the stationary proximity sensor's field of view may create a parabolic curve (with voltage on the y-axis and angle of rotation on the x-axis). As mail-pieces are fed, this data may be tracked and when a phase shift is detected a "double" alert may be declared as described with respect to FIGS. 5 through 8 (illustrating the impact of the change in distance d caused by a double). Such a design 300 may provide an accurate way of declaring a double for a rotary feeder when space is limited. The design 300 may integrate over the cycle position region where the gripper 340 grips the mail-piece in the hopper. Over that region, the system may find the lowest voltage value (representing the greatest decrease in voltage from the proximity sensor 320). This is the position at which the flag 330 on the gripper covers the greatest amount of proximity sensor's field of view. The system may record the cycle position at this lowest voltage point (representing an expected cycle position when a local minimum voltage value for a single mail-piece should occur). The system may compare a current cycle position to the cycle positions of the last five valid mail-pieces to make sure that the cycle position is within expected boundaries. If the system detects a phase shift from the expected cycle position outside of a tolerance region, the mail-piece is invalid (as being either too thick or too thin). If it is within the tolerance region, the system may take the average of the current mail-piece and the last four valid mail-pieces as a new expected cycle position.

Figure 4:
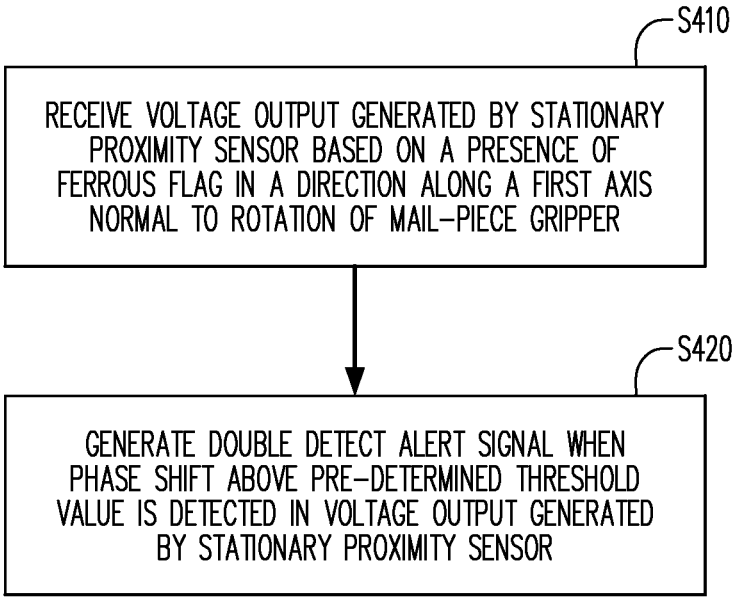
FIG. 4 is a double feed detection method according to some embodiments.

FIG. 4 is a double feed detection method that might be performed by some or all of the elements of the system 300 described with respect to FIG. 3. The flow charts described herein do not imply a fixed order to the steps, and embodiments of the present invention may be practiced in any order that is practicable. Note that any of the methods described herein may be performed by hardware, software, or any combination of these approaches. For example, a computer-readable storage medium may store thereon instructions that when executed by a machine result in performance according to any of the embodiments described herein.

At S410, a double detection apparatus may receive a voltage output generated by a stationary proximity sensor based on a presence of a detectable flag in a direction along a first axis normal to the rotation of a mail-piece gripper of a mail-piece rotary feeder. According to some embodiments, the detectable flag may be affixed to the rotating mail-piece gripper. At S420, a decision unit of the double detection apparatus may generate a double detect alert signal when a phase shift above a pre-determined threshold value is detected in the voltage output generated by the stationary proximity sensor.

Figures 5, 6:
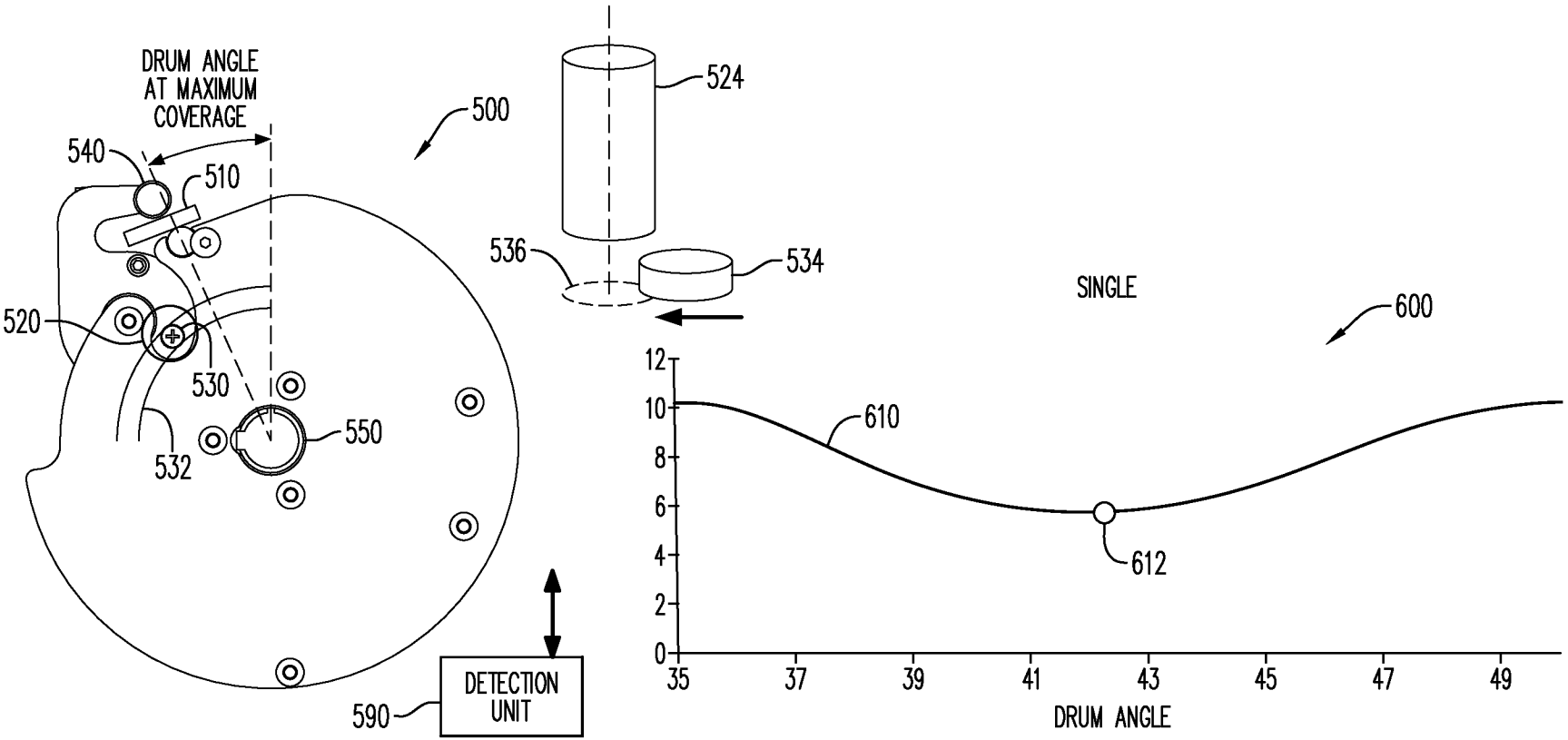
FIG. 5 is a side view of a rotary feeder processing a single mail-piece feed in accordance with some embodiments.
FIG. 6 is a graph of proximity sensor voltage output while processing a single mail-piece feed according to some embodiments.

Note that embodiments may be able to process various types of mail-pieces including "heavies" such as a 3.15 millimeter ("mm") thick (5.75 inch×8.25 inch) saddle stitched book or a 6.27 mm thick (7.875 inch×5.75 inch) saddle stitched book. FIG. 5 is a side view of a rotary feeder 500 processing a single mail-piece 510 feed in accordance with some embodiments. As before, a stationary proximity sensor 520 generates a voltage output based on a presence of a detectable flag 530 in a direction along a first axis normal to the rotation of a mail-piece gripper 540 about an axis 550 (causing the flag 530 to travel along path 532). A decision unit 590 may then be provided to generate a double detect alert signal when a phase shift above a pre-determined threshold value is detected in the voltage output generated by the stationary proximity sensor 520.

Note that the mail-piece gripper 540 may be associated with a drum angle that rotates 360 degrees to process each mail-piece 510. Moreover, the stationary proximity sensor 520 may be located such that movement of the detectable flag 530 generates a repeating voltage output waveform 610 illustrated in graph 600 of FIG. 6 as the drum angle changes. That is, the repeating voltage output waveform 610 might result from the detectable flag 534 "eclipsing" a field of view 536 of the stationary proximity sensor 524 along the first axis (into the page as illustrated by the close-up portion of FIG. 5). As a result of such motion, the voltage output waveform might comprise a parabolic waveform with a local minimum 612 (approximately 42 degrees as illustrated in FIG. 6) representing a drum angle at which a single mail-piece should result in maximum coverage between the flag 530 and the sensor 520.

Figure 7:
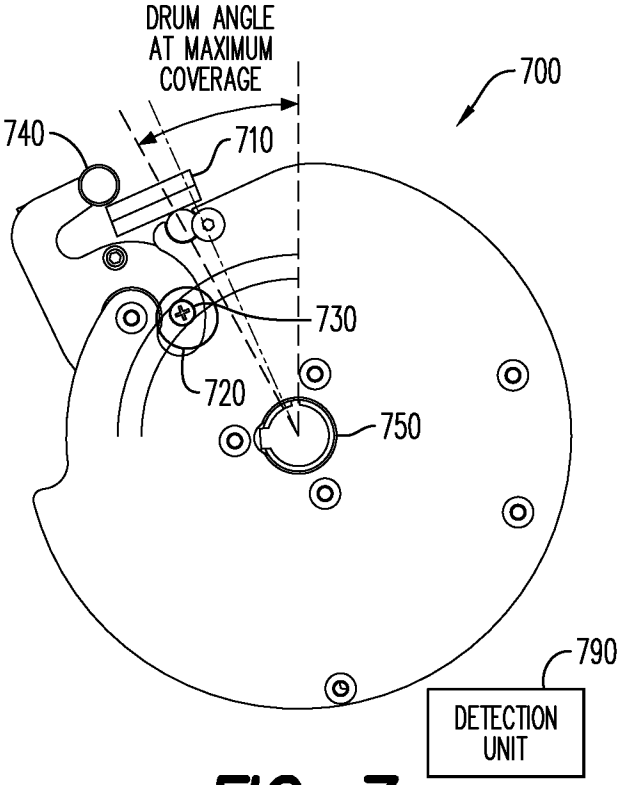
FIG. 7 is a side view of a rotary feeder processing a double mail-piece feed in accordance with some embodiments.

FIG. 7 is a side view of a rotary feeder 700 processing a double mail-piece 710 feed in accordance with some embodiments. As before, a stationary proximity sensor 720 generates a voltage output based on a presence of a detectable flag 730 in a direction along a first axis normal to the rotation of a mail-piece gripper 740 about an axis 750 (causing the flag 730 to travel along path 732). A decision unit 790 may then be provided to generate a double detect alert signal when a phase shift above a pre-determined threshold value is detected in the voltage output generated by the stationary proximity sensor 720.

Figure 8:
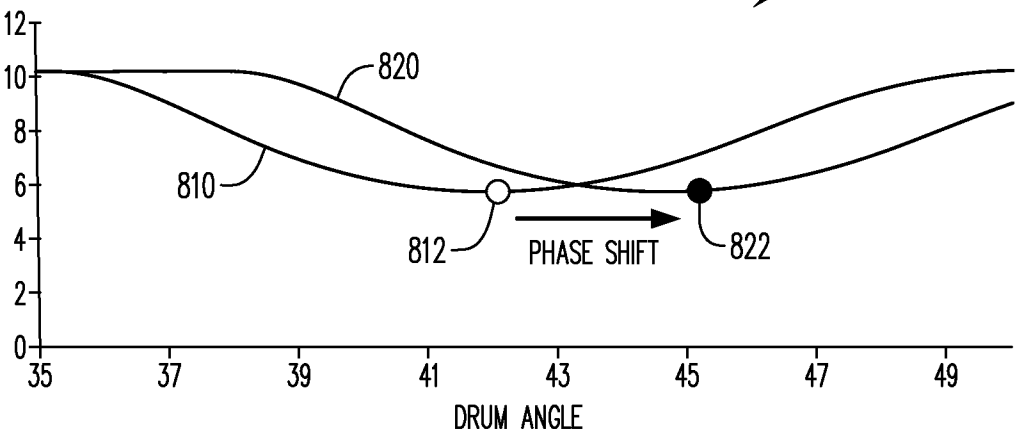
FIG. 8 is a graph of proximity sensor voltage output while processing a double mail-piece feed according to some embodiments.

The mail-piece gripper 740 may be associated with a drum angle that rotates 360 degrees to process each mail-piece 710. Moreover, the stationary proximity sensor 720 may be located such that movement of the detectable flag 730 generates a repeating voltage output waveform 820 illustrated in graph 800 of FIG. 8 as the drum angle changes. That is, the repeating voltage output waveform 820 might result from the detectable flag eclipsing a field of view of the stationary proximity sensor along the first axis (into the page). As a result of such motion, the voltage output waveform might comprise a parabolic waveform with a local minimum 822 (approximately 45 degrees as illustrated in FIG. 8) representing a drum angle at which a single mail-piece should result in maximum coverage between the flag 730 and the sensor 720. Note that the drum angle has increased as compared to the single-piece illustration of FIGS. 5 and 6 as demonstrated by the dotted line and the phase shift from the original waveform 810 and the original local minimum 812. This phase shift might result in the decision unit 790 shutting down the inserter (to protect it from damage).

Figure 9:
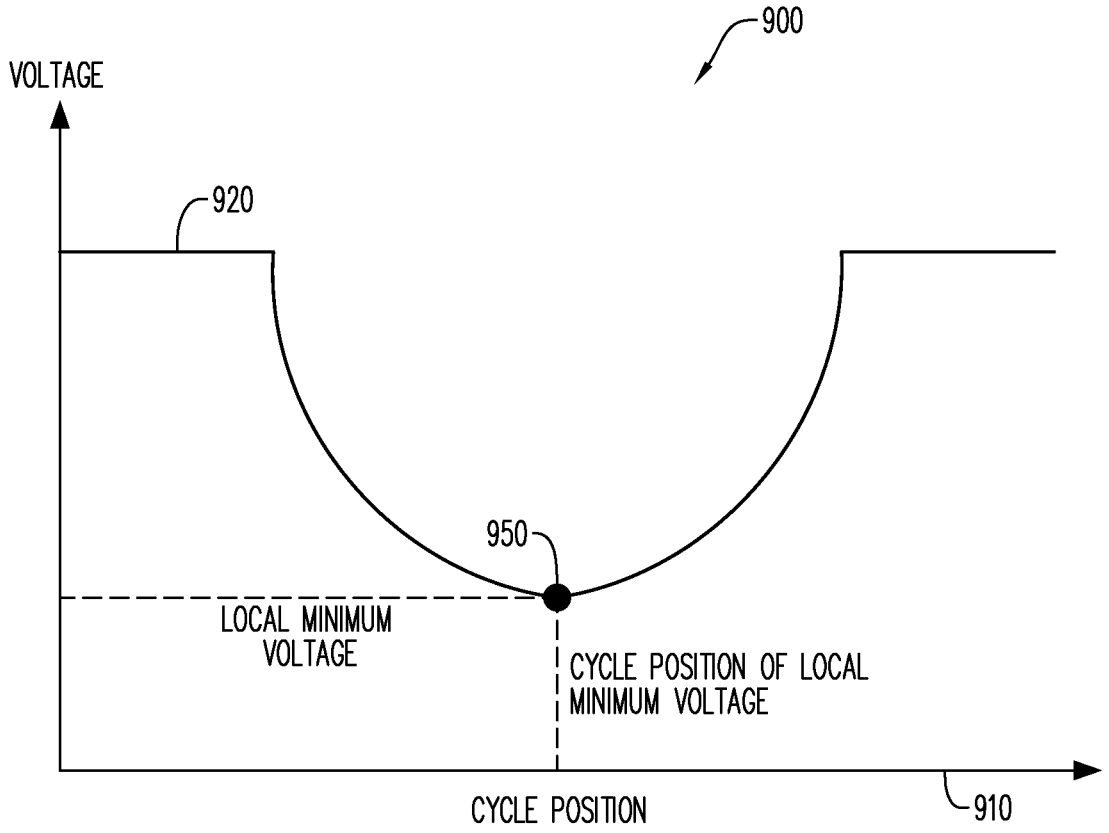
FIG. 9 illustrates an expected voltage profile processing a single mail-piece feed in accordance with some embodiments.

FIG. 9 illustrates 900 a graph 910 (with voltage as the y-axis and drum angle cycle position as the x-axis) showing an expected voltage profile 920 while processing a single mail-piece feed in accordance with some embodiments. According to some embodiments, over time an integrator may collect the lowest voltage value (the "local minimum voltage") and pass back the cycle position 950 associated with that lowest voltage value. For example, an average of the last five cycle positions of single pieces may be kept. That average of those five cycles may determine where the system "expects" to see a single piece. According to some embodiments, two threshold parameters may be maintained: a ThinThreshold and a ThickThreshold (e.g., each might be set to 1 degree, but this value can be changed).

Figure 10:
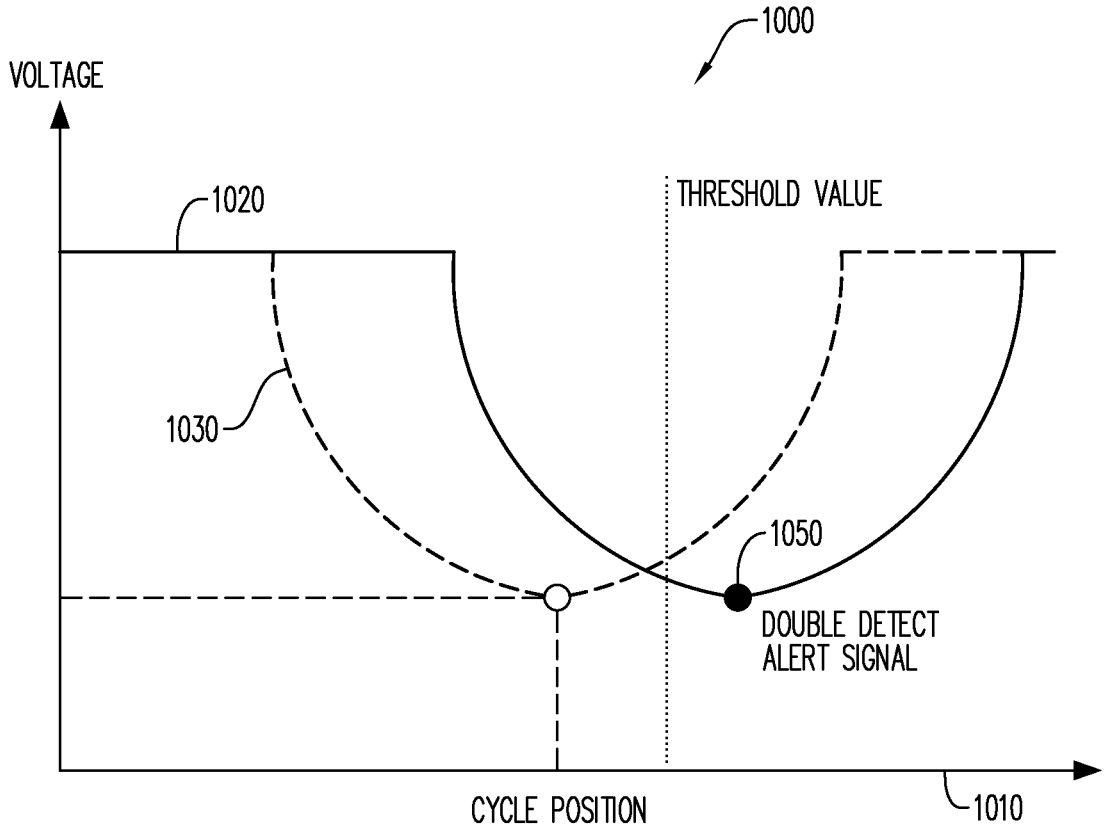
FIG. 10 illustrates a voltage profile processing a double mail-piece feed according to some embodiments.

FIG. 10 illustrates 1000 a graph 1010 showing a voltage profile 1020 (solid line) while processing a double mail-piece feed according to some embodiments. Note the phase shift between the local minimum 1050 of the solid line 1020 as compared to the expected voltage 1030 (the dashed line). If it is higher than the average cycle position plus the ThickThreshold, the system may generate a "Double Feed Jam" alert. According to some embodiments, the rotary may calibrate a double detect threshold based on an initial or first mail-piece that is processed. The average single piece cycle position may represent an average of up to the last five valid readings of single piece cycle positions (not including mail-pieces that were determined to be too thick or too thin).

Figure 11:
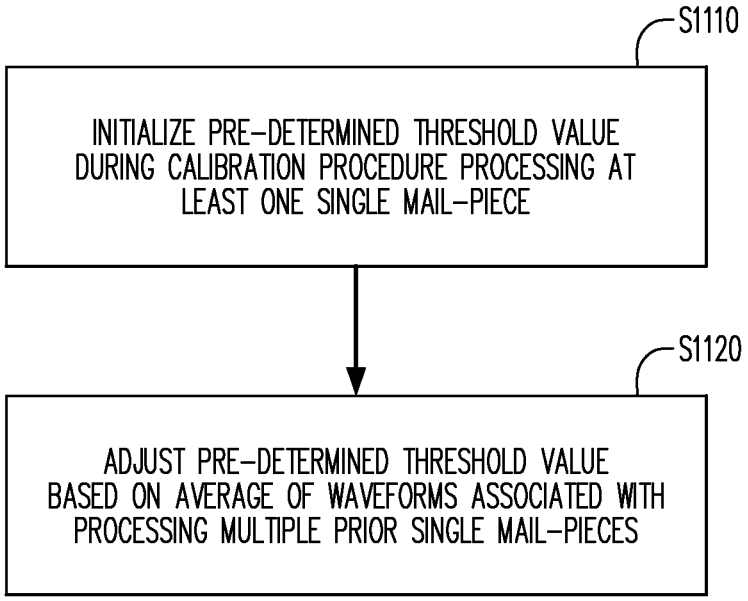
FIG. 11 is a method of determining a threshold parameter in accordance with some embodiments.

FIG. 11 is a method of determining a threshold parameter in accordance with some embodiments. At S1110, a pre-determined threshold value may be initialized during a calibration procedure processing at least one single mail-piece. The initialized pre-determined threshold value may then be adjusted at S1120 based on a waveform associated with the processing of at least one prior single mail-piece. For example, the pre-determined threshold value might be adjusted based on an average of waveforms associated with the processing of multiple prior single mail-pieces.

A heavies rotary phase shift double detect may perform the following process to determine an expected cycle position associated with a single mail-piece in a gripper:

1. Integrate over the cycle position region where the gripper grips the piece in the hopper.
2. Over that region, find the lowest voltage value (representing the greatest decrease in voltage from the proximity sensor). This may be the position at which the flag on the gripper covers the greatest amount of the proximity sensor.
3. Take the cycle position at the lowest voltage point. This is the expected cycle position when the system should see a local minimum voltage value for a single piece.
4. Compare this cycle position to the cycle positions of the last five valid pieces (to make sure the cycle position is within expected boundaries).
5. If the system detects a phase shift of the cycle position outside of a tolerance region, the piece is invalid (e.g., too thick). If it is within the tolerance region, the system takes the average of the current piece and the last four valid pieces (as a new expected cycle position).

Figure 12:
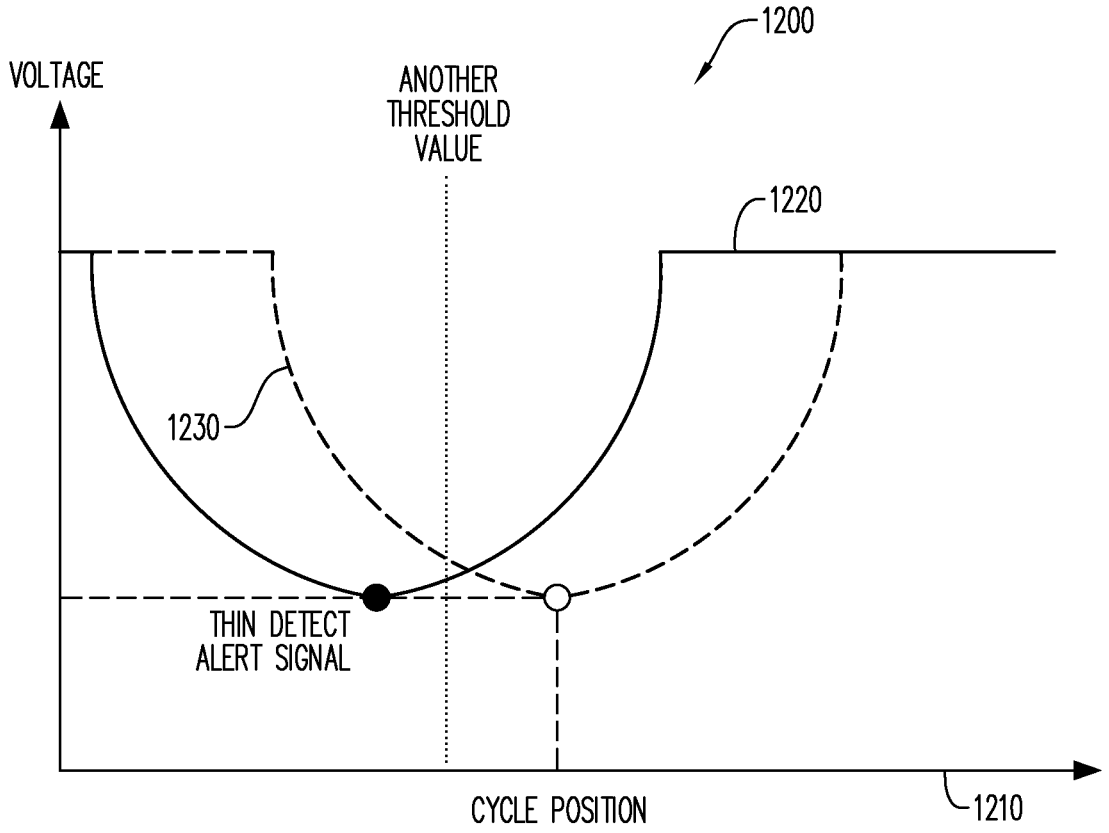
FIG. 12 illustrates a voltage profile processing a "too thin" mail-piece feed according to some embodiments.

According to some embodiments, a decision unit might also generate a thin detect alert signal when a phase shift past another pre-determined threshold value is detected in a voltage output generated by a stationary proximity sensor. For example, FIG. 12 illustrates 1200 a graph 1210 showing a voltage profile 1220 processing a "too thin" mail-piece feed according to some embodiments. Note the phase shift between the local minimum 1250 of the solid line 1220 as compared to the expected voltage 1230 (the dashed line). When a piece enters the gripper, the system may check to see if the new cycle position returned is within the ThinThreshold of the average cycle position. If the new cycle position is lower than the average cycle position minus the ThinThreshold, the system may throw a "Piece Too Thin" alert.

Figure 13:
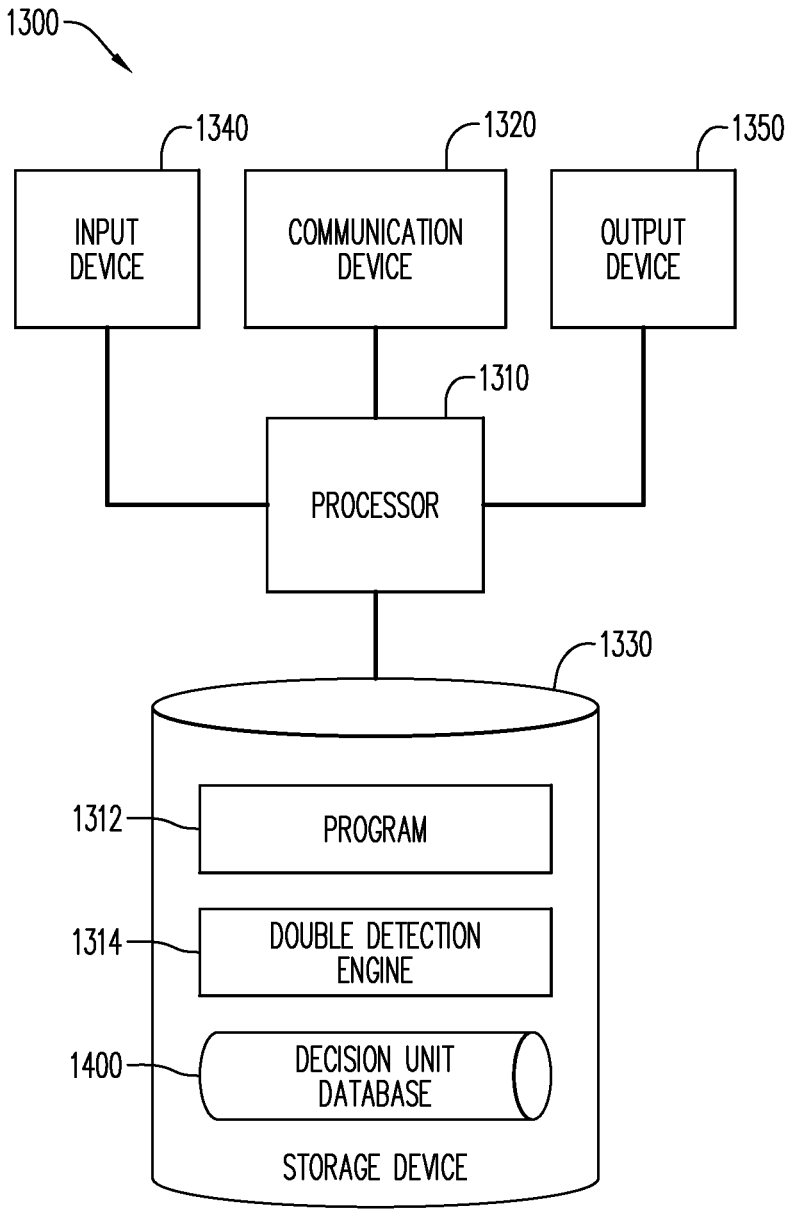
FIG. 13 illustrates a double detection platform or apparatus in accordance with some embodiments.

Note that the embodiments described herein may be implemented using any number of different hardware configurations. For example, FIG. 13 is a block diagram of a double detection apparatus 1300 that may be, for example, associated with the system 300 of FIG. 3 and/or any other system described herein. The double detection apparatus 1300 comprises a processor 1310, such as one or more commercially available Central Processing Units ("CPUs") in the form of one-chip microprocessors, coupled to a communication device 1320 configured to communicate via a communication network (not shown in FIG. 13). The communication device 1360 may be used to communicate, for example, with one or more remote control panels, operator displays, etc. The double detection apparatus 1300 further includes an input device 1340 (e.g., a computer mouse and/or keyboard to input information about information) and/an output device 1350 (e.g., a computer monitor to render a display, generate an inserter shut-down signal or alert, and/or create reports). According to some embodiments, a mobile device and/or a PC may be used to exchange information with the double detection apparatus 1300.

The processor 1310 also communicates with a storage device 1330. The storage device 1330 may comprise any appropriate information storage device, including combinations of magnetic storage devices (e.g., a hard disk drive), optical storage devices, mobile telephones, and/or semiconductor memory devices. The storage device 1330 stores a program 1312 and/or a double detection engine 1314 for controlling the processor 1310. The processor 1310 performs instructions of the programs 1312, 1314, and thereby operates in accordance with any of the embodiments described herein. For example, the processor 1310 may receive a voltage output from a proximity based on a presence of a detectable flag in a direction along a first axis normal to the rotation of a mail-piece gripper. The processor 1310 may then generate a double detect alert signal when a phase shift above a pre-determined threshold value is detected in the voltage output generated by the stationary proximity sensor. According to some embodiments, the processor 1310 may also generate a thin detect alert signal when a phase shift past another pre-determined threshold value is detected in the voltage output generated by the stationary proximity sensor.

The programs 1312, 1314 may be stored in a compressed, uncompiled and/or encrypted format. The programs 1312, 1314 may furthermore include other program elements, such as an operating system, clipboard application, a database management system, cloud computing capabilities, and/or device drivers used by the processor 1310 to interface with peripheral devices.

As used herein, information may be "received" by or "transmitted" to, for example: (i) the wind turbine protection platform 1300 from another device; or (ii) a software application or module within the wind turbine protection platform 1300 from another software application, module, or any other source.

In some embodiments (such as the one shown in FIG. 13), the storage device 1330 further stores a decision unit database 1400. An example of a decision unit database 1400 that may be used in connection with the double detection apparatus 1300 will now be described in detail with respect to FIG. 14. Note that the database described herein is only one example, and additional and/or different information may be stored therein. Moreover, various databases might be split or combined (and or implemented via a cloud computing environment) in accordance with any of the embodiments described herein.

Referring to FIG. 14, a table is shown that represents the decision unit database 1400 that may be stored at the double detection apparatus 1300 according to some embodiments. The table may include, for example, entries identifying insertion systems. The table may also define fields 1402, 1404, 1406, 1408, 1410, 1412 for each of the entries. The fields 1402, 1404, 1406, 1408, 1410, 1412 may, according to some embodiments, specify: an inserter identifier 1402, a rotary feeder identifier 1404, a date and time 1406, a minimum voltage drum angle 1408, an average of the last five drum angles 1410, and a status 1412. The decision unit database 1400 may be created and updated, for example, based on information received from a stationary proximity sensor.

The inserter identifier 1402 and rotary feeder identifier 1404 may be a unique alpha-numeric code identifying and/or describing an insertion system being monitored for double feed errors. The date and time 1406 might represent when measurements were recorded (e.g., once per processed mail piece). The minimum voltage drum angle 1408 may represent when a detectable flag most completely aligned with a proximity sensor. The average of the last five drum angles 1410 might represent where the system "expects" this alignment to occur for a single mail-piece. The status 1412 might indicate if the current drum angle 1410 with within a degree of tolerance of the average 1410 (and, if not, the status 1412 might indicate an "alert" that shuts down the inserted because a double has been detected).

Thus, embodiments may provide an improved "double detection" apparatus that can quickly and accurately detect the presence of a double in a geometrically efficient manner. The apparatus may provide for relative early detection of doubles to better avoid damage to an inserter.

Although specific hardware and data configurations have been described herein, note that any number of other configurations may be provided in accordance with embodiments of the present invention (e.g., in other types of mail-piece insertion systems). Moreover, although some embodiments are focused on particular mail-piece sizes (e.g., thicknesses, any of the embodiments described herein could be applied to other types of mail-pieces.

The present invention has been described in terms of several embodiments solely for the purpose of illustration. Persons skilled in the art will recognize from this description that the invention is not limited to the embodiments described but may be practiced with modifications and alterations limited only by the spirit and scope of the appended claims.

The invention claimed is:

1. A double detection apparatus for a mail-piece inserter, comprising:

a detectable flag affixed to a rotating mail-piece gripper of a mail-piece rotary feeder;

a stationary proximity sensor to generate a voltage output based on a presence of the detectable flag in a direction along a first axis normal to the rotation of the mail-piece gripper; and a decision unit to generate a double detect alert signal when a phase shift above a pre-determined threshold value is detected in the voltage output generated by the stationary proximity sensor.

2. The apparatus of claim 1, wherein mail-piece gripper is associated with a drum angle that rotates 360 degrees to process each mail-piece, and the stationary proximity sensor is located such that movement of the detectable flag generates a repeating voltage output waveform as the drum angle changes.

3. The apparatus of claim 2, wherein the repeating voltage output waveform results from the detectable flag eclipsing a field of view of the stationary proximity sensor along the first axis.

4. The apparatus of claim 3, wherein the voltage output waveform comprises a parabolic waveform.

5. The apparatus of claim 1, wherein the pre-determined threshold value is initialized during a calibration procedure processing at least one single mail-piece.

6. The apparatus of claim 5, wherein the initialized pre-determined threshold value is adjusted based on a waveform associated with the processing of at least one prior single mail-piece.

7. The apparatus of claim 6, wherein the pre-determined threshold value is adjusted based on an average of waveforms associated with the processing of multiple prior single mail-pieces.

8. The apparatus of claim 1, wherein the decision unit is further to generate a thin detect alert signal when a phase shift past another pre-determined threshold value is detected in the voltage output generated by the stationary proximity sensor.

9. A method for a mail-piece inserter, comprising:

receiving, at a double detection apparatus, a voltage output generated by a stationary proximity sensor based on a presence of a detectable flag in a direction along a first axis normal to the rotation of a mail-piece gripper of a mail-piece rotary feeder, wherein the detectable flag is affixed to the rotating mail-piece gripper; and generating, by a decision unit of the double detection apparatus, a double detect alert signal when a phase shift above a pre-determined threshold value is detected in the voltage output generated by the stationary proximity sensor.

10. The method of claim 9, wherein mail-piece gripper is associated with a drum angle that rotates 360 degrees to process each mail-piece, and the stationary proximity sensor is located such that movement of the detectable flag generates a repeating voltage output waveform as the drum angle changes.

11. The method of claim 10, wherein the repeating voltage output waveform results from the detectable flag eclipsing a field of view of the stationary proximity sensor along the first axis and the voltage output waveform comprises a parabolic waveform.

12. The method of claim 9, wherein the pre-determined threshold value is initialized during a calibration procedure processing at least one single mail-piece.

13. The method of claim 12, wherein the initialized pre-determined threshold value is adjusted based on a waveform associated with the processing of at least one prior single mail-piece.

14. The method of claim 13, wherein the pre-determined threshold value is adjusted based on an average of waveforms associated with the processing of multiple prior single mail-pieces.

15. The method of claim 9, wherein the decision unit is further to generate a thin detect alert signal when a phase shift past another pre-determined threshold value is detected in the voltage output generated by the stationary proximity sensor.

16. A mail-piece inserter, comprising:

a feed tower holding mail-pieces;

an envelope feeder holding envelopes;

an insertion station to place mail-pieces into envelopes using a rotating mail-piece gripper; and a double detection apparatus, including:

a detectable flag affixed to the rotating mail-piece gripper, a stationary proximity sensor to generate a voltage output based on a presence of the detectable flag in a direction along a first axis normal to the rotation of the mail-piece gripper, and a decision unit to generate a double detect alert signal when a phase shift above a pre-determined threshold value is detected in the voltage output generated by the stationary proximity sensor.

17. The mail-piece inserter of claim 16, wherein mail-piece gripper is associated with a drum angle that rotates 360 degrees to process each mail-piece, and the stationary proximity sensor is located such that movement of the detectable flag generates a repeating voltage output waveform as the drum angle changes.

18. The mail-piece inserter of claim 17, wherein the repeating voltage output waveform results from the detectable flag eclipsing a field of view of the stationary proximity sensor along the first axis and the voltage output waveform comprises a parabolic waveform.

19. The mail-piece inserter of claim 16, wherein the pre-determined threshold value is initialized during a calibration procedure processing at least one single mail-piece and the initialized pre-determined threshold value is adjusted based on a waveform associated with the processing of at least one prior single mail-piece.

20. The mail-piece inserter of claim 16, wherein the decision unit is further to generate a thin detect alert signal when a phase shift past another pre-determined threshold value is detected in the voltage output generated by the stationary proximity sensor.

* * * * *